US006686890B2

(12) United States Patent
James et al.

(10) Patent No.: US 6,686,890 B2
(45) Date of Patent: Feb. 3, 2004

(54) SLOT-ARRAY ANTENNAS WITH SHAPED RADIATION PATTERNS AND A METHOD FOR THE DESIGN THEREOF

(75) Inventors: Geoffrey James, Sydney (AU); Francis Cooray, Sydney (AU); Trevor Bird, Sydney (AU); John O'Sullivan, Sydney (AU); R. Evans Wetmore, Manhattan Beach, CA (US)

(73) Assignee: Fox Broadcasting Company, Los Angeles, CA (US)

( * ) Notice: Subject to any disclaimer, the term of this patent is extended or adjusted under 35 U.S.C. 154(b) by 69 days.

(21) Appl. No.: 10/109,767

(22) Filed: Mar. 29, 2002

(65) Prior Publication Data

US 2003/0016180 A1 Jan. 23, 2003

Related U.S. Application Data

(60) Provisional application No. 60/285,500, filed on Apr. 19, 2001.

(51) Int. Cl.[7] ..... H01Q 13/12
(52) U.S. Cl. ..... 343/770; 343/771
(58) Field of Search ..... 343/767, 770, 343/771, 772, 790, 791, 853

(56) References Cited

U.S. PATENT DOCUMENTS

| | | | | |
|---|---|---|---|---|
| 2,724,774 A | | 11/1955 | Fiet | |
| 2,756,421 A | * | 7/1956 | Harvey et al. | 554/12 |
| 2,807,018 A | | 9/1957 | Woodward, Jr. | |
| 3,005,984 A | | 10/1961 | Winter et al. | |
| 3,183,511 A | | 5/1965 | Ajioka | |
| 3,243,818 A | | 3/1966 | Holtzman | |
| 3,328,800 A | | 6/1967 | Algeo | |
| 3,648,172 A | | 3/1972 | Nakahara et al. | |
| 3,729,740 A | * | 4/1973 | Nakahara et al. | 343/713 |
| 4,297,706 A | | 10/1981 | Nikolayuk | |
| 4,322,699 A | | 3/1982 | Hildebrand et al. | |
| 4,554,551 A | | 11/1985 | Frazita | |
| 4,590,480 A | | 5/1986 | Nikolayuk et al. | |
| 4,907,008 A | | 3/1990 | Dienes | |
| 5,021,797 A | | 6/1991 | Dienes | |
| 5,276,413 A | | 1/1994 | Schulze-Buxloh | |
| 5,291,164 A | | 3/1994 | Levisse | |
| 5,546,096 A | * | 8/1996 | Wada | 343/771 |
| 5,638,079 A | | 6/1997 | Kastner et al. | |
| 5,917,454 A | * | 6/1999 | Hill et al. | 343/769 |
| 5,929,821 A | * | 7/1999 | Goldstein et al. | 343/770 |
| 5,955,997 A | * | 9/1999 | Ho et al. | 343/767 |
| 6,313,806 B1 | * | 11/2001 | Schadler | 343/767 |
| 6,480,163 B1 | * | 11/2002 | Knop et al. | 343/770 |
| 6,542,130 B2 | * | 4/2003 | Falk et al. | 343/771 |

FOREIGN PATENT DOCUMENTS

| | | |
|---|---|---|
| EP | 0 300 147 A1 | 5/1988 |
| GB | 1321582 | 6/1973 |

OTHER PUBLICATIONS

"Tailoring the Footprint of a Wireless Communications Cell", IBM® Technical Disclosure Bulletin, vol. 34, No. 4B, Sep. 1991.

* cited by examiner

*Primary Examiner*—Tan Ho
(74) *Attorney, Agent, or Firm*—Blakely, Sokoloff, Taylor & Zafman LLP

(57) ABSTRACT

An irregular arrangement of slots in a cylindrical slot-array antenna is used to control the radiation pattern, achieving a variation of gain and/or beam tilt with azimuth. A design methodology for slot-array antennas achieves efficient and rapid optimization by minimizing the number of degrees of freedom and the number of significant mutual-coupling interactions. A useful range of designs is achieved by requiring that the slots are arranged in bays and that all slots, and their probes, are identical. Bays are separated by approximately a wavelength and, therefore, mutual coupling between bays can be ignored. Although the antenna slots are physically grouped into bays, the analytical approach groups the slots into paths defined by a simultaneous variation in z and $\phi$ coordinates of the slots.

30 Claims, 10 Drawing Sheets

SLOT-ARRAY ANTENNAS WITH SHAPED RADIATION PATTERNS AND A METHOD FOR THE DESIGN THEREOF

RELATED APPLICATION

This application claims priority of co-pending provisional application No. 60/285,500 filed Apr. 19, 2001.

BACKGROUND OF THE INVENTION

1. Field of the Invention

This invention relates to the design of cylindrical slot-array antennas used for broadcasting in the VHF and UHF bands.

2. Background

Television broadcasters are concerned with providing sufficient transmission signal to the maximum number of customers within the constraint of the permissible transmitted power. It is desirable to match the broadcast antenna design as closely as possible to the distribution of customers, the terrain, and the propagation conditions around the transmitter location. For the digital TV market in the United States, for example, the aim is to control the radiation pattern to maximize the number of viewers reached by the FCC regulated transmission license for each area. New requirements call for antennas in which not only the gain but also the beam tilt can be adjusted for each azimuth.

Television signals are commonly broadcasted from slot-array antennas. A diagram of a typical cylindrical slot-array antenna 10 is shown in FIG. 1, together with a coordinate system for analyzing the antenna pattern. The antenna comprises an array of radiating slots 12 cut into a circular cylindrical waveguide 14 that stands vertically at the broadcast site. The waveguide is a metal pipe supporting an interior guided wave to carry energy to the slots. To support a single guided wave, the waveguide commonly has a metal inner conductor 16 along its axis and is therefore a coaxial waveguide. The input to the antenna is at one end, where the guided wave passes through a matching network to ensure that the antenna will operate across the required broadcast band. At the other end is a termination that is usually a short circuit. The slots may have a circumferential orientation to generate vertically polarized radiation or an axial orientation to generate horizontally polarized radiation. They may also be tilted at an arbitrary angle, and different slots may have different tilts. Mounted at or near each slot there may be a metal probe that protrudes into the waveguide, coupling energy from the guided wave to radiate through the slot.

The radiation pattern of a broadcast antenna is the variation of radiated power, of either vertical or horizontal polarization, as a function of azimuth and elevation angles. At any azimuth angle, the elevation pattern is the variation of radiated power as a function of elevation angle at a constant distance from a chosen origin. The radiated power in any direction may be expressed as a gain with respect to a reference antenna. Instead of azimuth and elevation the coordinates $\theta$ and $\phi$ shown in FIG. 1 may be used according to the relationships $$\text{azimuth}=360^\circ-\phi$$

$$\text{elevation}=90^\circ-\theta$$

where $\theta$ and $\phi$ are expressed in degrees. Broadcast antennas are designed so that the peak of the elevation pattern is slightly below the horizon, directing the strongest possible signal to distant customers. The elevation angle of the peak is called the beam tilt.

The positions of slots on the cylinder may be specified by their $(\phi,z)$ coordinates where z increases from the input to the termination. A group of slots with the same z coordinate is called a bay. Present antenna designs have slots arranged in a $(\phi,z)$ grid, and therefore comprise a set of identical bays spaced in z along the cylinder. The elevation patterns of such an antenna all have the same shape, and therefore the same beam tilt, regardless of azimuth. The variation of the peak gain with azimuth is determined by the arrangement of slots within a bay. The peak gain may be nearly constant or strongly varying, according to the requirements of the broadcast location.

SUMMARY OF THE INVENTION

The present invention uses the arrangement of slots in a cylindrical slot-array antenna to control the radiation pattern. In particular, an irregular arrangement permits the gain and/or beam tilt to vary with azimuth. Alternatively, an irregular variation of some property of the slots or their probes may be used to achieve a varying gain and beam tilt, even when the slots are positioned in a regular manner. There are many possible design variables. Slots may or may not have different dimensions. Slots may be axial, circumferential, tilted at an arbitrary angle, or a combination of these. Each slot may or may not have a coupling probe in its aperture or protruding into the waveguide or outside the cylinder. A coupling probe is used to excite a radiating field in the aperture of a slot that would not normally radiate; for example, axial slots in a coaxial waveguide require probes.

The present invention also provides an antenna design methodology that achieves efficient and rapid optimization by minimizing the number of degrees of freedom and the number of significant mutual-coupling interactions. A useful range of designs is achieved by requiring that the slots are arranged in bays and that all slots, and their probes, are identical. Designs of this kind are more convenient to manufacture and have greater structural integrity than designs with arbitrary slot placement or different slot and probe dimensions. Because, to achieve beams near the horizon, bays are separated by approximately a wavelength, mutual coupling between bays can be ignored, thereby speeding the design process significantly. Grouping slots into bays also assists in achieving a tunable design—that is, an antenna that will operate across the required broadcast band.

Although the antenna slots are physically grouped into bays, the analytical approach groups the slots into slot paths defined by a simultaneous variation in z and $\phi$ coordinates of the slots. Constant increments in both z and $\phi$ produce a helix that twists around and along the cylinder; in existing designs $\phi$ is constant, producing a vertical column. Bay alignment is maintained by having identical z variations in all slot paths. The variations of all array parameters, such as slot position $(\phi,z)$, slot size and tilt, probe dimensions, and equivalent circuit parameters, are specified using the method of increments described below.

Grouping slots into paths is important because changing $\phi$ variations allows a useful control of the radiation pattern with a very small number of free parameters. This leads to an efficient optimization. For example, an array with 4 slots in each bay is represented by 4 slot paths. Bay alignment requires each slot path to have the same z variation and tuning the antenna typically requires 3 degrees of freedom for z in the method of increments. Useful pattern shaping can be done with 2 degrees of freedom for the $\phi$ variation in each slot path, in which case the whole array geometry is specified using just $3+4\times2=11$ parameters.

Arranging slots in bays reduces drastically the number of coupling interactions that need to be considered. Coupling interactions in a bay are accounted for by perturbing the shunt admittances that represent slots—replacing element admittances by active admittances. The analysis also justifies using the same equivalent circuit for slots and bays.

By making all of the slots identical, the mutual admittance between each pair of slots in a bay can be interpolated from a few pre-calculated values. The scattering matrix for coupling interactions can then be calculated and the admittance perturbations depend simply on the scattering matrix elements. This procedure allows optimization to include coupling effects with almost no speed penalty.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

The radiation pattern of a slot-array antenna may be controlled using either:

1) an arrangement of slots on the cylinder that is not a regular (ϕ,z) grid, or
2) a grid arrangement of slots that have properties varying in an irregular manner.

By "a (ϕ,z) grid" we mean that slots occupy every position defined by taking coordinates from a set of discrete, but not necessarily evenly spaced, values of ϕ and z. By "varying in an irregular manner" we mean that some property of the slots or their probes is not a separable function of (ϕ,z), that is, $$f(\phi,z)\neq f_{\phi}(\phi)f_{z}(z)$$

where $f(\phi,z)$ is some dimension or parameter of the slot located at (ϕ,z) or its probe. The slots in the former case may also have properties varying in an irregular manner to modify the effect of their non-grid arrangement.

Figure 1:
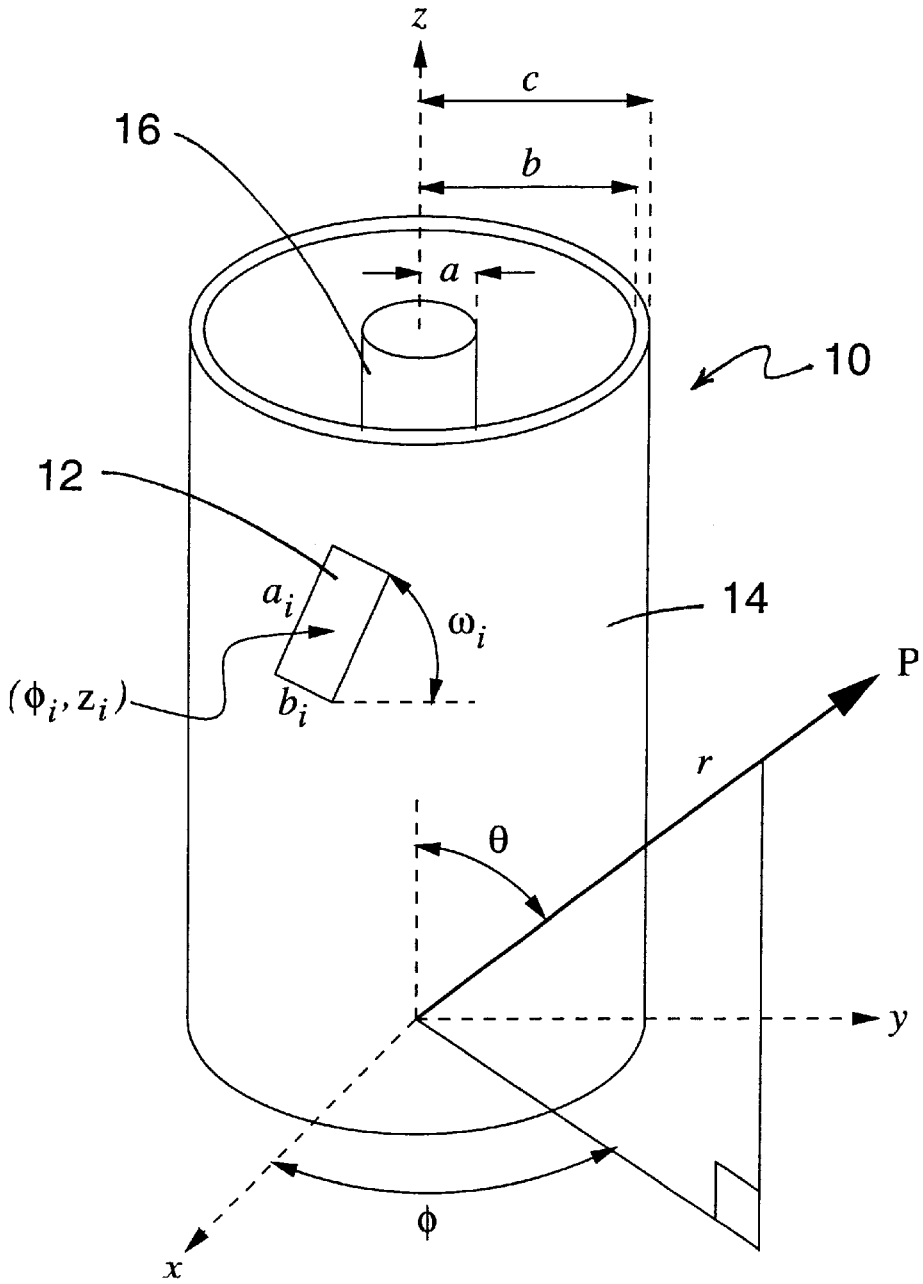
FIG. 1 is a diagram of a cylindrical slot-array antenna on a coaxial waveguide.
Figures 2A, 2B, 2C:
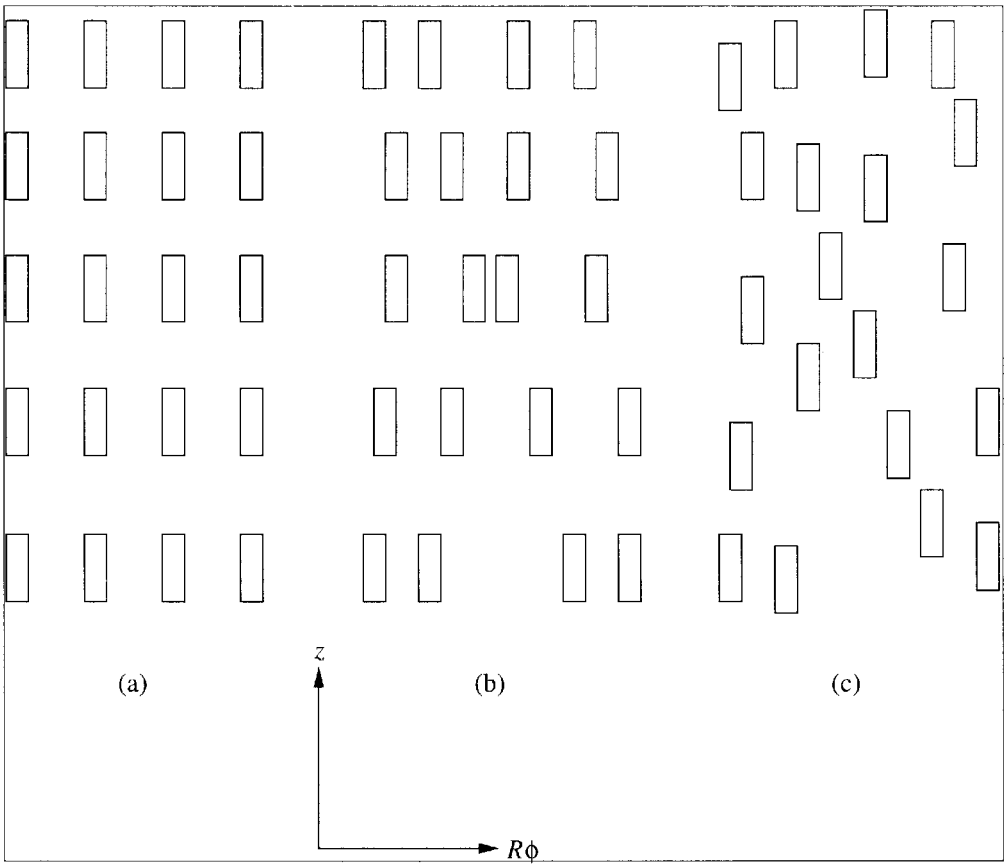
FIGS. 2*a*–2*c* illustrate three degrees of regularity in the arrangement of slots on an unwrapped view of a cylindrical surface.

FIGS. 2*a*–2*c* illustrate three degrees of regularity in the arrangement of slots. FIG. 2*a* shows an arrangement that is typical of conventional antenna designs, wherein slots are grouped into identical bays that are spaced along the cylinder. In FIG. 2*b*, the bays are no longer identical and the elevation patterns at different azimuth angles will no longer have the same shape. In FIG. 2*c*, all symmetry is lost and the placement of slots is arbitrary. Arrangements like those of FIGS. 2*b* and 2*c* allow significant variations of the elevation pattern, and in particular the beam tilt, with azimuth.

Figures 3A, 3B, 3C, 3D:
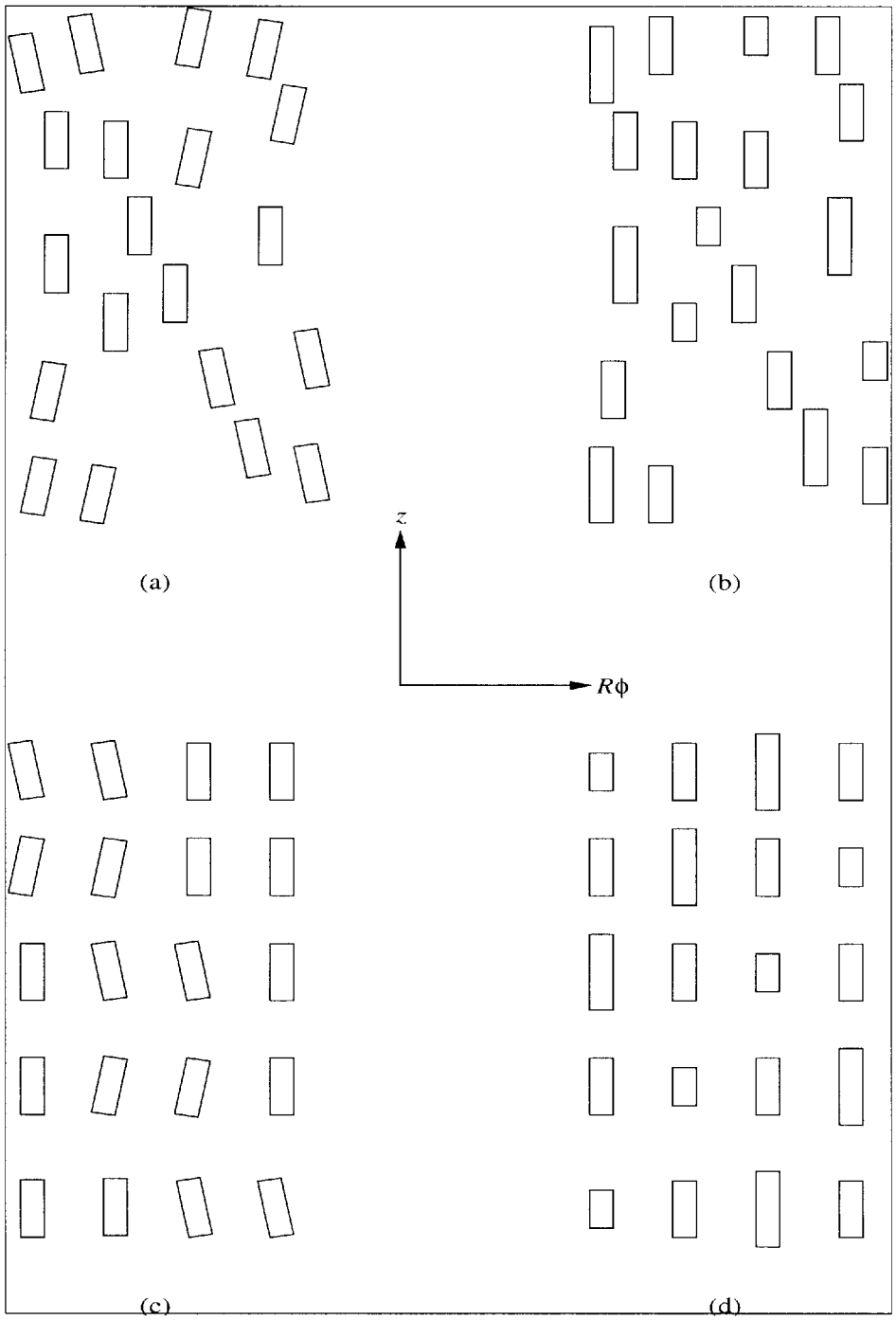
FIGS. 3*a*–3*d* illustrate slot-array design variables for controlling an antenna pattern.

FIGS. 3*a*–3*d* show some of the possibilities for pattern control as defined above. FIGS. 3*a* and 3*b* illustrate variations in slot tilt and slot length, respectively, to augment the pattern control already achieved by non-grid placement of slots. In the context of a (ϕ,z) grid of slots, FIGS. 3*c* and 3*d* illustrate the use of non-separable variations in slot tilt and slot length, respectively, to achieve pattern control.

Radiation patterns may be efficiently calculated using a transmission-line analysis of the waveguide. In this analysis, an equivalent circuit reproduces the electromagnetic behavior of each slot and its probe to a good approximation. Standard circuit analysis allows the excitation of each slot to be calculated. The radiation pattern of a single slot in a cylindrical surface is well known, so the radiation pattern of the slot array may be calculated by summing the individual radiation patterns multiplied by the excitations.

Figure 4:
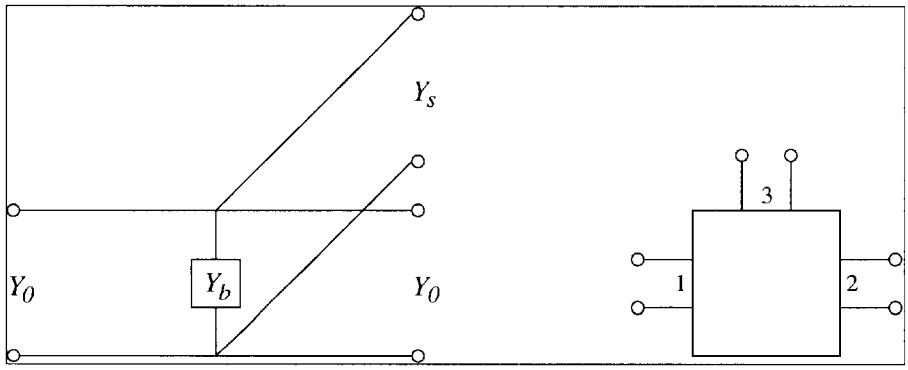
FIG. 4 is an equivalent circuit representing the electromagnetic behavior of a slot and its probe in the transmission-line analysis of a slot array.

FIG. 4 illustrates a suitable equivalent circuit for a radiating slot. The slot is modeled as a transmission line with a characteristic admittance $Y_s$ shunted across the line that represents the coaxial waveguide. A branch transmission line with an additional lumped-element admittance $Y_b$ is placed in parallel with the slot. The scattering matrix for this equivalent circuit is:

$$S^{slot}=\begin{pmatrix} \frac{-y_s-y_b}{2+y_s+y_b} & \frac{2}{2+y_s+y_b} & \frac{2\sqrt{y_s}}{2+y_s+y_b} \\ \frac{2}{2+y_s+y_b} & \frac{-y_s-y_b}{2+y_s+y_b} & \frac{2\sqrt{y_s}}{2+y_s+y_b} \\ \frac{2\sqrt{y_s}}{2+y_s+y_b} & \frac{2\sqrt{y_s}}{2+y_s+y_b} & \frac{-2+y_s-y_b}{2+y_s+y_b} \end{pmatrix}$$

in terms of $y_s=Y_s/Y_0$ and $y_b=Y_b/Y_0$, the admittances normalized with respect to the characteristic admittance $Y_0$ of the coaxial waveguide.

Figure 5:
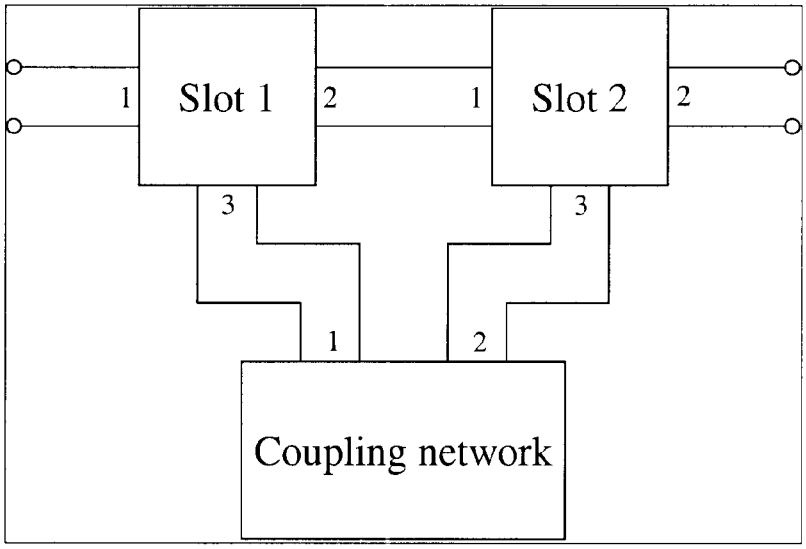
FIG. 5 is a network representation of a 2-slot bay with coupling.
Figure 6:
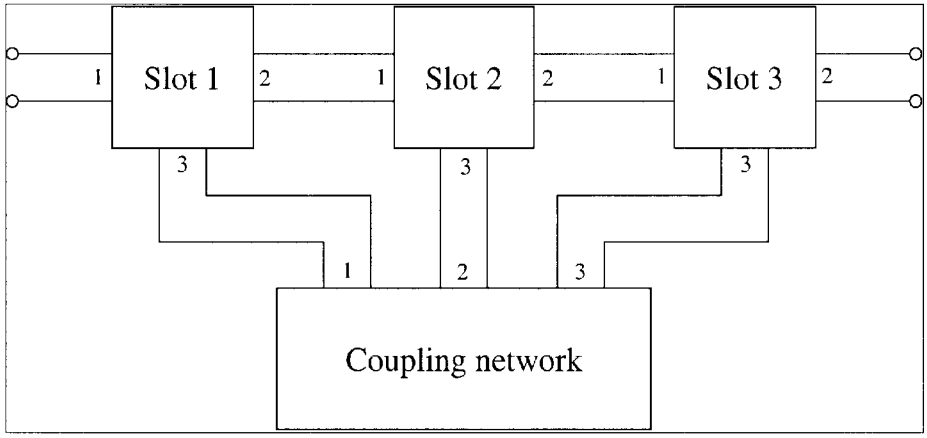
FIG. 6 is a network representation of a 3-slot bay with coupling.
Figure 7:
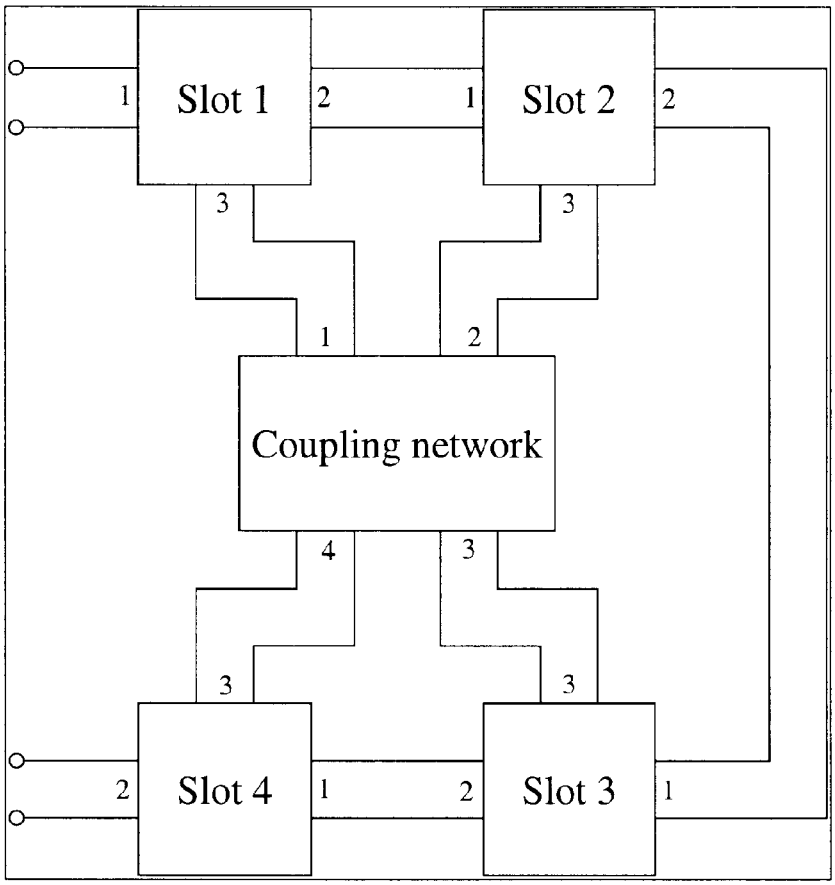
FIG. 7 is a network representation of a 4-slot bay with coupling.

Mutual coupling between slots occurs via fields exterior to the cylinder and fields inside the cylindrical waveguide. Applying the transmission line model of the array, mutual coupling between slots within a bay may be represented by a network that joins the slot ports. The coupling network has as many ports as there are slots in the bay. FIGS. 5 to 7 show the slots and coupling networks for bays with 2 to 4 slots, respectively. The mutual coupling components can be calculated as mutual admittances between the slot ports numbered 3 in each of the figures. Provided that all slots are identical, the mutual admittances between slots can be estimated rapidly by interpolating pre-calculated data.

The networks for bays with 2 to 4 slots can be solved by setting up equations in the unknown forward and reverse voltages in each connecting line. We assume that all the slots are identical. Solving these equations with arbitrary $S^{coup}$ is a substantial problem, but one that can be reliably handled by a symbolic algebra program such as the REDUCE Computer Algebra System available from the University of Cologne. Constructing the scattering matrix for an entire bay, which in FIGS. 5 to 7 is a two-port equivalent circuit, shows that a bay continues to behave as a shunt admittance regardless of coupling within it. Although intuitively sensible, this is not an obvious result.

In principle, interior and exterior mutual admittances between all pairs of slots in the array should be used in a correct calculation of the radiation pattern. However, because the coupling effect falls off rapidly with the z separation of slots, only mutual admittances between slots in the same bay need to be considered. The diagonal elements of the scattering matrix for coupling within a single bay are zero because the behavior of the slots in isolation is completely described by their equivalent circuits. Therefore, $$S^{coup} = \begin{pmatrix} 0 & S_{12} \\ S_{12} & 0 \end{pmatrix} \text{ for 2 slots,}$$

$$S^{coup} = \begin{pmatrix} 0 & S_{12} & S_{13} \\ S_{12} & 0 & S_{23} \\ S_{13} & S_{23} & 0 \end{pmatrix} \text{ for 3 slots, and}$$

$$S^{coup} = \begin{pmatrix} 0 & S_{12} & S_{13} & S_{14} \\ S_{12} & 0 & S_{23} & S_{24} \\ S_{13} & S_{23} & 0 & S_{34} \\ S_{14} & S_{24} & S_{34} & 0 \end{pmatrix} \text{ for 4 slots.}$$

By considering the independent scattering elements as free parameters, the bay's normalized admittance $y_{bay}$ simplifies considerably. Expressing it as a Taylor expansion which is second-order in the scattering elements, we find $$y_{bay} \approx 2(y_S+y_b)-4y_sS_{12}+4y_sS_{12}^{\ 2} \text{ for 2 slots,}$$

$$y_{bay} \approx 3(y_s+y_b)-4y_S(S_{12}+S_{13}+S_{23})+4y_S(S_{12}^{\ 2}+S_{13}^{\ 2}+S_{23}^{\ 2}+S_{12}S_{13}+S_{12}S_{23}+S_{13}S_{23}) \text{ for 3 slots, and}$$

$$y_{bay} \approx 4(y_s + y_b) - 4y_s\sum_{i<j} S_{ij} + 4y_s\left(\sum_{i<j} S_{ij}^2 + \sum_{i<j,k<l,ij\neq kl} S_{ij}S_{kl}\right) \text{ for 4 slots.}$$

Recall that all slots have the same admittance $y_s+y_b$, and observe that, when there is no coupling, these expressions reduce as expected to the sum of the slot admittances.

Rather than doing a full circuit analysis that includes the scattering matrices of the coupling network, a perturbation is applied to the admittances $Y_s$ in FIG. 4. This allows the effect of coupling to be included in the transmission-line model of the array with no additional network calculations, leading to a very fast calculation. The following perturbations are suggested by inspecting the Taylor expansion expressions given above:

$$\begin{aligned} y_1 &\to y_s + y_b - 2y_s[S_{12} - S_{12}^2] \\ y_2 &\to y_s + y_b - 2y_s[S_{12} - S_{12}^2] \quad \text{for 2 slots,} \\ y_{bay} &= y_1 + y_2 \end{aligned}$$

$$\begin{aligned} y_1 &\to y_s + y_b - 2y_s[(S_{12} + S_{13}) - (S_{12} + S_{13})^2] \\ y_2 &\to y_s + y_b - 2y_s[S_{12} + S_{23}) - (S_{12} + S_{23})^2] \\ y_3 &\to y_s + y_b - 2y_s[(S_{13} + S_{23}) - (S_{13} + S_{23})^2] \quad \text{for 3 slots, and} \\ y_{bay} &= y_1 + y_2 + y_3 \end{aligned}$$

-continued $$\begin{aligned} y_1 &\to y_s + y_b - 2y_s[(S_{12} + S_{13} + S_{14}) - (S_{12} + S_{13} + S_{14})^2] \\ y_2 &\to y_s + y_b - 2y_s[S_{12} + S_{23} + S_{24}) - (S_{12} + S_{23} + S_{24})^2] \\ y_3 &\to y_s + y_b - 2y_s[(S_{13} + S_{23} + S_{34}) - (S_{13} + S_{23} + S_{34})^2] \quad \text{for 4 slots.} \\ y_4 &\to y_s + y_b - 2y_s[(S_{14} + S_{24} + S_{34}) - (S_{14} + S_{24} + S_{34})^2] \\ y_{bay} &= y_1 + y_2 + y_3 + y_4 \end{aligned}$$

A general expression is:

$$Y_s \to Y_s - 2Y_s(S - S^2)$$

where:

$$S = \Sigma(\text{scattering elements affecting the slot in question})$$

These sum to produce the correct bay admittances to second order. For example, the admittance for the slot designated 1 in a 3-slot bay is perturbed according to:

$$Y_s \to Y_s - 2Y_s[(S_{12}^{\ coup} + S_{13}^{\ coup}) - (S_{12}^{\ coup} + S_{13}^{\ coup})^2]$$

in which the $S^{coup}$ elements all have first or second index 1. When the perturbed admittances are used in the transmission-line analysis of the waveguide, the changes in slot excitations due to mutual coupling are reproduced to second order in the $S^{coup}$ elements. This method is much faster and simpler than a full circuit analysis, to the extent that coupling calculations can be included in the optimization of the antenna with almost no speed penalty.

While the analysis has been limited to bays with 2 to 4 slots, it can reasonably be expected that bays with more slots will follow the same pattern.

There are several important implications:

- A bay with coupling continues to behave as a shunt admittance. Therefore, the two port equivalent circuit remains valid regardless of coupling; coupling will simply distort the parameters of the circuit. Identical bays will have identical equivalent admittances because coupling is assumed to be confined to within bays.
- A bay with coupling continues to be representable as a set of discrete slots, and the bay admittance continues to be the sum of the slot admittances. Therefore the same equivalent circuit can be used for slots as for bays, with appropriately modified circuit parameters.
- The coupling calculation is fast enough to include in the optimizer, provided that the scattering elements can be calculated quickly. This is accomplished by interpolation of pre-calculated data.
- Coupling will not affect the range of radiation patterns that can be achieved, just the slot parameters required to achieve them. Bays will generally have different equivalent admittances because, even with a constant slot and probe configuration, coupling will perturb the equivalent slot admittances differently in different bays. A constant equivalent admittance could only be achieved by a variable slot and probe configuration, and the range of variation required might exceed the tuning capability of the probes.

Efficient optimization of antenna designs as discussed below is aided by a description of the slot array that has a small number of independent parameters. Useful designs tend to have strong alignments of slots on the cylindrical surface, and this observation leads to the use of slot paths to describe the slot positions. The same concept may be used to describe the variation of other slot and probe parameters, but to simplify manufacture they are usually kept constant.

Figure 8:
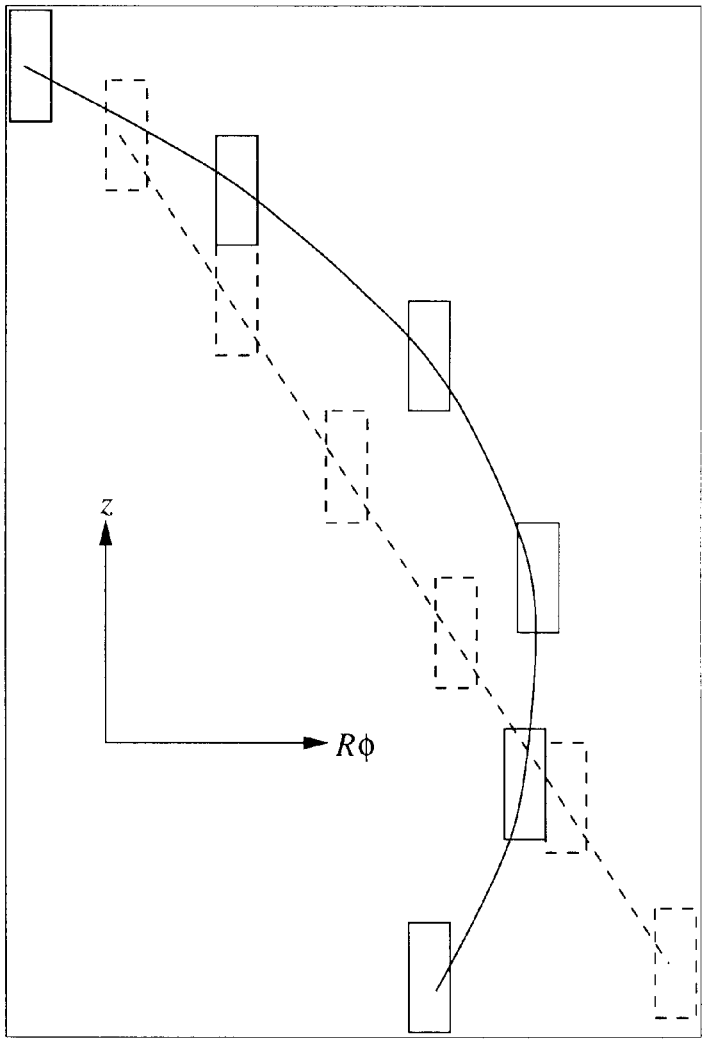
FIG. 8 illustrates a helix compared to a general slot path for specifying slot locations.

Slots arranged in a helix are separated by constant increments $\delta\phi$ and $\delta z$—they lie along a straight line on the developed cylindrical surface. A generalized slot path is obtained by varying At $\delta\phi$ and $\delta z$ using second- and higher-order increments. An example is shown in FIG. 8, alongside a helix for comparison. The coordinates of the first slot and the first increments of each order are independent parameters, and the remaining increments and coordinates may be calculated systematically. For example, if second-order increments are provided, the independent parameters are $\{\phi_1, \delta\phi_1, \delta\delta\phi_1, z_1, \delta z_1, \delta\delta z_1\}$ and subsequent coordinates are calculated as follows.

$$\begin{array}{ll} \delta\phi_2 = \delta\phi_1 + \delta\delta\phi_1 & \delta z_2 = \delta z_1 + \delta\delta z_1 \\ \delta\phi_3 = \delta\phi_2 + \delta\delta\phi_1 & \delta z_3 = \delta z_2 + \delta\delta z_1 \\ \text{etc.} & \text{etc.} \\ \phi_2 = \phi_1 + \delta\phi_1 & z_2 = z_1 + \delta z_1 \\ \phi_3 = \phi_2 + \delta\phi_2 & z_3 = z_2 + \delta z_2 \\ \phi_4 = \phi_3 + \delta\phi_3 & z_4 = z_3 + \delta z_3 \\ \text{etc.} & \text{etc.} \end{array}$$

The highest-order increment, it can be seen, remains constant. This algorithm may be efficiently coded for computation.

The advantages of a slot-path representation are as follows.

- Slot arrangements of great utility for pattern shaping may be specified efficiently by grouping slots into one or more slot paths.
- Other array features, such as slot dimensions, slot tilts, probe lengths, and equivalent circuit parameters, may be specified in a similar way if desired, giving a homogeneous description of the array.
- Optimization of the array is fast due to the small number of independent parameters needed in a slot-path representation.

The design of a practical antenna utilizing the present invention may conveniently begin with a standard design with identical bays producing a uniform beam tilt and gain. The design is then optimized using an automatic algorithm. Antennas with slots arranged in bays are preferred for structural integrity, easier tuning, and faster coupling calculations. It is important, then, for the optimization algorithm to maintain bay alignments while varying the independent parameters defining several paths of slots. This can be arranged by using the same z parameters for all slot paths. Then each slot path contributes one slot to every bay. Some manual adjustment of slot-path parameters may be required to assist the automatic optimizer to reach a practical solution. A particular optimization algorithm that has been found useful in this application is the downhill simplex method of Nelder and Mead (Computer Journal, vol. 7, p. 308, 1965).

The following procedure may be used to arrive at a preliminary design with constant beam tilt:

- Read the gain and beam-tilt variations and generate a constraint file with constant beam tilt, a suitable maximum gain, gain-difference limit, and return-loss limit. The weighted average beam tilt is then calculated.
- Select sufficient slots per bay to allow the desired pattern variation (four for notch patterns; however, a two-cycle beam-tilt variation may be achieved using two slot paths).
- Set the number of bays to get approximately the right gain and beamwidth.
- Set the bay spacing to give the average of the desired beam tilt at the band center.
- Express $Y_s$ and $Y_b$ in FIG. 4 as functions of frequency so that the equivalent circuit reproduces the observed behavior of a slot.
- Use the optimization algorithm described below to select bay z coordinates (using 3 degrees of freedom), and slot equivalent circuit (with identical slots throughout the array) to obtain a tunable array with acceptable gain difference while maintaining a similar beam tilt. Optimize at three frequencies simultaneously, the band centre and lower and upper limits.
- Inspect the variation of gain and beam width across the band, and if necessary change the number of bays and repeat the previous steps.

Once the preliminary design is achieved, the optimization algorithm proceeds as follows:

- Read the gain and beam-tilt variations and generate a new constraint file that specifies the full variations.
- Optimize z coordinates (using 3 degrees of freedom common to all slot paths), $\phi$ coordinates (using 3 degrees of freedom for each slot path), and slot equivalent circuit (with identical slots throughout the array) to obtain a tunable array with acceptable gain difference while approaching more closely the desired radiation pattern.
- Restart this optimization at least twice from the result of the previous run. Each restart explores the region of the best solution so far much more thoroughly than would be done in a single run. This lessens the chance of entrapment by local minima.

It has been found that allowing more than 3 degrees of freedom for $\phi$ increases the optimization time without improving the solution. Allowing every slot to have independent $\phi$ may give some benefits, but the optimization time becomes very long, and solutions with overlapping slots are more likely to arise. Such slots can be combined, complicating the design process.

Array designs are optimized using any robust numerical optimization technique that varies the free parameters to minimize a measure of convergence. Various measures may be used. The required radiation pattern for a broadcast location is typically described by graphs of peak gain and beam tilt against azimuth angle. Ideally, the measure of convergence should incorporate all the desirable properties of the antenna, including the input match, the gain and beam tilt of elevation patterns, and the gain difference. Such a measure is defined as a sum:

$$M_1 = M_{gain} + M_{diff} + M_{vswr}$$

$M_{gain}$ measures the closeness of an achieved radiation pattern to the desired radiation pattern at a selection of field directions $(\theta_l, \phi_l))$ for $^{l=1,\ldots,N}$. Typically the desired pattern is specified by a lower bound of gain in the region of the elevation beam. For a shaped pattern the required lower bound varies with azimuth, to reflect varying beam tilt and peak gain, so the N directions must include a range of azimuth and elevation angles.

$M_{diff}$ measures how much the radiation pattern violates the gain-difference requirement. Typically, we aim to limit the gain variation across the 6-MHz band to no more than 3 dB in every direction where there may be customers.

$M_{vswr}$ measures how easily the antenna may be matched across the band using a tuning network.

Field directions where the achieved gain is greater than the desired gain, or the gain variation is less than 3 dB, do not contribute to $M_{gain}$ or $M_{diff}$ respectively. $M_{vswr}$ is zero if the worst voltage standing-wave ratio is less than a desired minimum.

The measures $M_{gain}$, $M_{diff}$, and $M_{vswr}$ are defined so that $M_1=0$ when all the design constraints are satisfied. A problem with using a single measure of convergence is that the optimization routine cannot distinguish the different constraints. For example, a design with a poor pattern and a good return loss might have the same measure as a design that is not tunable but has a good pattern. In general, we are willing to compromise the pattern constraints if we must, but a design is no use at all if it has an unacceptable gain difference across the band or if it cannot be tuned. Therefore, an alternative measure with a higher weighting for the more important constraints may be used.

It has been found that the component $M_{gain}$ does not always correlate well with desired pattern features: a given variation of gain and tilt of the elevation beam. Another measure of convergence that has been found useful in place of $M_{gain}$ is denoted $M_{peak}$. Given pattern constraints at $N_{100}$ azimuth angles, the elevation peaks are located in the desired and achieved patterns and measures the $N_\phi$ differences in peak gain and beam tilt. The overall measure of convergence becomes:

$$M_2=M_{peak}+M_{diff}+M_{vswr}$$

Figure 9:
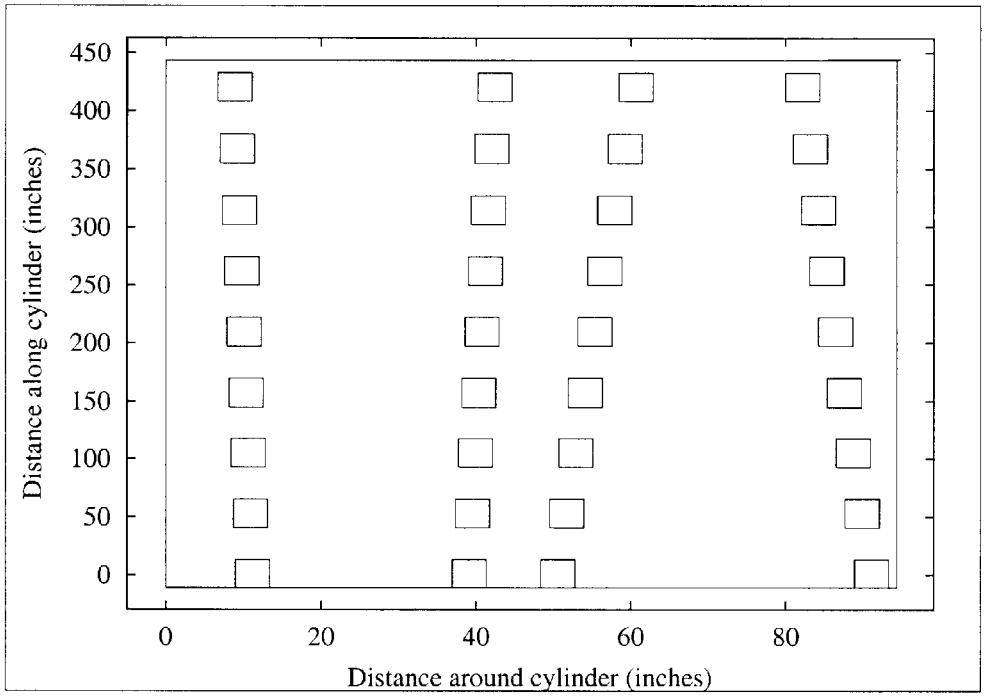
FIG. 9 illustrates a slot arrangement of an exemplary antenna design.
Figure 10:
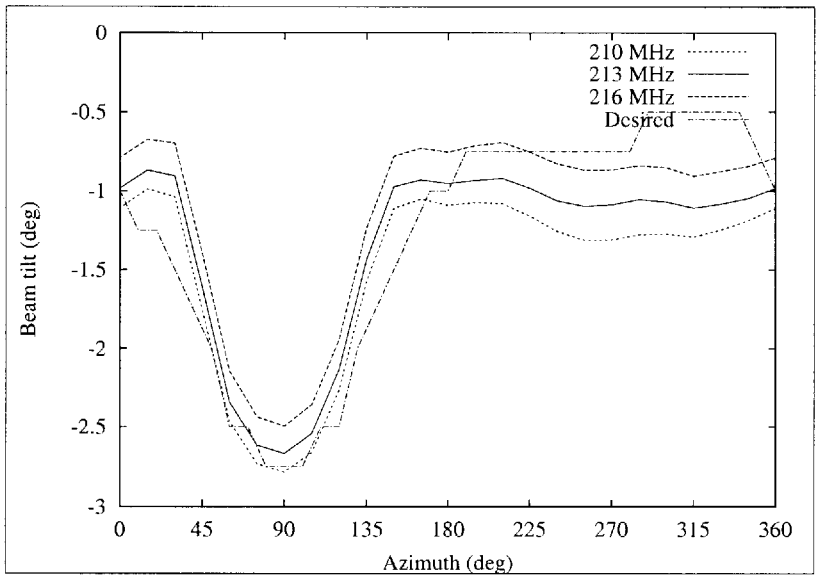
FIG. 10 is a graph of antenna beam tilt for the exemplary antenna design of FIG. 9.

An example antenna, comprising 36 slots aligned in 9 bays, has been optimized for particular local requirements. The slot arrangement, exhibiting a gentle variation of the slot azimuths along the cylinder, is shown in FIG. 9. The elevation beam tilt is graphed against azimuth in FIG. 10 at three frequencies in the band of operation. A dip in beam tilt in the region around 90° azimuth has been effected.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A slot array antenna having a shaped radiation pattern comprising a cylindrical waveguide defined by z,ϕ coordinates with a plurality of slots arranged in an irregular pattern, thereby producing a non-uniform radiation pattern wherein the slots are arranged to produce a radiation pattern with beam tilt that varies as a function of azimuth.

2. The slot array antenna of claim 1 wherein the slots are arranged in bays of constant z coordinate, within which slots are spaced apart by non-uniform distances in the ϕ dimension.

3. The slot array antenna of claim 1 wherein the slots are arranged in columns of constant ϕ coordinate, within which slots are spaced apart by non-uniform distances in the z dimension.

4. The slot array antenna of claim 1 wherein the slots are arranged to produce a radiation pattern with gain that varies as a function of azimuth.

5. A slot array antenna having a shaped radiation pattern comprising a cylindrical waveguide defined by z, ϕ coordinates with a plurality of non-uniform slots, thereby producing a non-uniform radiation pattern.

6. The slot array antenna of claim 5 wherein the slots have non-uniform dimensions.

7. The slot array antenna of claim 6 wherein the slots have non-uniform lengths.

8. The slot array antenna of claim 6 wherein the slots have non-uniform widths.

9. The slot array antenna of claim 5 wherein the slots have non-uniform tilt angles.

10. The slot array antenna of claim 5 wherein at least some of the plurality of slots have associated coupling probes.

11. The slot array antenna of claim 10 wherein the coupling probes associated with the slots are non-uniform.

12. The slot array antenna of claim 11 wherein the non-uniformity of the coupling probes is specified to produce a radiation pattern with gain that varies as a function of azimuth.

13. The slot array antenna of claim 11 wherein the non-uniformity of the coupling probes is specified to produce a radiation pattern with beam tilt that varies as a function of azimuth.

14. The slot array antenna of claim 5 wherein the non-uniformity of the slots is specified to produce a radiation pattern with gain that varies as a function of azimuth.

15. The slot array antenna of claim 5 wherein the non-uniformity of the slots is specified to produce a radiation pattern with beam tilt that varies as a function of azimuth.

16. A method of estimating a radiation pattern of a slot-array antenna comprising:

modeling each radiating slot with an equivalent transmission line circuit;

calculating an admittance value for each slot;

calculating mutual admittance values for pairs of slots within a predefined proximity;

calculating scattering matrix elements that account for coupling within each bay;

calculating a perturbed admittance value for each slot utilizing the scattering matrix elements corresponding to the bay that contains said each slot;

calculating a radiation pattern of each slot in accordance with the perturbed admittance value; and summing the radiation patterns of all slots in the array.

17. The method of claim 16 wherein the perturbed admittance value for each slot is calculated as:

$$Y_s \rightarrow Y_s - 2Y_s(S-S^2)$$

where:

$$S=\Sigma(\text{scattering elements affecting said each slot}).$$

18. The method of claim 16 wherein the slots are physically arranged in bays and mutual admittance values are calculated for pairs of slots within the same bay.

19. The method of claim 16 wherein all slots in the array are modeled with the same equivalent transmission line circuit.

20. The method of claim 16 wherein the antenna comprises a cylindrical waveguide and wherein slot locations are defined by a generalized slot path.

21. A method of designing a slot-array antenna comprising:

(a) defining an array of identical slots physically arranged in bays;

(b) defining an equivalent transmission line circuit for the slots;

(c) calculating an admittance value for the slots;

(d) calculating mutual admittance values for pairs of slots within each bay;

(e) calculating scattering matrix elements that account for coupling within each bay;

(f) calculating a perturbed admittance value for each slot utilizing the scattering matrix elements corresponding to the bay that contains said each slot;

(g) calculating a radiation pattern of each slot in accordance with the perturbed admittance value;

(h) summing the radiation patterns of all slots in the array;

(i) comparing the summed radiation pattern with a target radiation pattern;

(j) if a measure of difference between the summed radiation pattern and the target radiation pattern exceeds a predetermined value, adjusting the location or equivalent circuit of at least one slot in the array and repeating (c) –(j).

22. The method of claim 21 wherein the perturbed admittance value for each slot is calculated as:

$$Y_s \rightarrow Y_s - 2Y_s(S - S^2)$$

where:

$$S = \Sigma(\text{scattering elements affecting said each slot}).$$

23. The method of claim 21 wherein the antenna comprises a cylindrical waveguide and wherein slot locations are defined by a generalized slot path.

24. The method of claim 21 wherein the measure of difference comprises a shortfall of achieved peak gain compared to the desired peak gain.

25. The method of claim 24 wherein the measure of difference further comprises squaring and summing the shortfall of achieved peak gain compared to the desired peak gain over a selection of field points.

26. The method of claim 21 wherein the measure of difference comprises a difference in achieved beam tilt compared to the desired beam tilt.

27. The method of claim 26 wherein the measure of difference further comprises squaring and summing the difference in achieved beam tilt compared to the desired beam tilt over a selection of azimuth angles.

28. The method of claim 21 wherein the measure of difference includes a weighted component that measures antenna performance over a frequency band.

29. A method of calculating coupling interactions between radiating elements in an array comprising:

modeling each radiating element with an equivalent transmission line circuit;

calculating an admittance value for each radiating element;

calculating mutual admittance values for pairs of radiating elements within a predefined proximity;

calculating scattering matrix elements that account for coupling within each bay;

calculating a perturbed admittance value for each radiating element utilizing the scattering matrix elements corresponding to the bay that contains said each radiating element.

30. The method of claim 29 wherein the perturbed admittance value for each radiating element is calculated as:

$$Y_s \rightarrow Y_s - 2Y_s(S - S^2)$$

where:

$$S = \Sigma(\text{scattering elements affecting said each radiating element}).$$

* * * * *